US010424253B2

(12) United States Patent
Kim et al.

(10) Patent No.: US 10,424,253 B2
(45) Date of Patent: Sep. 24, 2019

(54) DISPLAY DEVICE AND POWER MONITORING CIRCUIT

(71) Applicant: LG DISPLAY CO., LTD., Seoul (KR)

(72) Inventors: Sangyong Kim, Paju-si (KR); Moo Kyoung Hong, Paju-si (KR)

(73) Assignee: LG Display Co., Ltd., Seoul (KR)

( * ) Notice: Subject to any disclaimer, the term of this patent is extended or adjusted under 35 U.S.C. 154(b) by 199 days.

(21) Appl. No.: 15/682,367

(22) Filed: Aug. 21, 2017

(65) Prior Publication Data

US 2018/0061326 A1 Mar. 1, 2018

(30) Foreign Application Priority Data

Aug. 30, 2016 (KR) ..... 10-2016-0111031

(51) Int. Cl.

*G09G 3/3275* (2016.01)
*G09G 3/36* (2006.01)
*G09G 3/3225* (2016.01)

(52) U.S. Cl.

CPC ..... *G09G 3/3275* (2013.01); *G09G 3/3225* (2013.01); *G09G 3/3674* (2013.01); *G09G 2300/08* (2013.01); *G09G 2310/0267* (2013.01); *G09G 2330/027* (2013.01); *G09G 2330/04* (2013.01); *G09G 2330/12* (2013.01)

(58) Field of Classification Search

CPC ..... G09G 2330/04; G09G 2330/044; G09G 2330/08

See application file for complete search history.

(56) References Cited

U.S. PATENT DOCUMENTS

| | | | | |
|---|---|---|---|---|
| 6,624,816 | B1 * | 9/2003 | Jones, Jr. | G06F 1/3218 345/503 |
| 2008/0077340 | A1 * | 3/2008 | Nguyen | G01R 31/40 702/64 |
| 2012/0081341 | A1 * | 4/2012 | Dunn | G09G 3/3406 345/207 |
| 2016/0104407 | A1 * | 4/2016 | Hong | G09G 3/3648 345/55 |
| 2016/0148570 | A1 * | 5/2016 | Lee | G09G 3/3225 345/211 |
| 2018/0061326 | A1 * | 3/2018 | Kim | G09G 3/3275 |

* cited by examiner

*Primary Examiner* — Kent W Chang
*Assistant Examiner* — Nathaniel P Brittingham
(74) *Attorney, Agent, or Firm* — Seed IP Law Group LLP

(57) ABSTRACT

A display device and a power monitoring circuit. The power monitoring circuit monitors whether or not first power is ordinarily output from a power management integrated circuit (PMIC). When the first power is not ordinarily output, the power monitoring circuit outputs an error detection signal indicative of an abnormality in the PMIC to a main controller. The display device includes the power monitoring circuit. The operating state of the PMIC supplying power required for the driving of a display panel can be monitored.

16 Claims, 10 Drawing Sheets

DISPLAY DEVICE AND POWER MONITORING CIRCUIT

CROSS REFERENCE TO RELATED APPLICATION

This application claims priority from Korean Patent Application No. 10-2016-0111031, filed on Aug. 30, 2016, which is hereby incorporated by reference for all purposes as if fully set forth herein.

BACKGROUND

Technical Field

Embodiments of the present disclosure relate to a display device and a power monitoring circuit.

Description of Related Art

In response to the development of the information society, demand for a variety of display devices for displaying images is increasing. In this regard, a range of display devices, such as liquid crystal display (LCD) devices, plasma display panels (PDPs), and organic light-emitting diode (OLED) display devices, have recently come into widespread use.

Such display devices include a display panel having a plurality of subpixels defined by a plurality of data lines and a plurality of gate lines, a data driver driving the plurality of data lines, and a gate driver driving the plurality of gate lines.

In the display device, various types of power must be supplied to the data driver, the gate driver, the display panel, or the like to drive the display panel.

However, when power is not properly supplied by a power source, the display panel may not operate properly, so that, for example, image quality may degrade or the display panel may be burnt.

BRIEF SUMMARY

Various aspects of the present disclosure provide a display device and a power monitoring circuit able to monitor the operating state of a power management integrated circuit (PMIC) supplying power required for the driving of a display panel.

Also provided are a display device and a power monitoring circuit able to monitor an abnormality in the PMIC supplying power required for the driving of the display panel, even in the case in which the PMIC is in an abnormal state (e.g., a shutdown event) and a panel controller fails to recognize the abnormality in the PMIC.

According to an aspect of the present disclosure, a display device may include: a display panel including a plurality of data lines and a plurality of gate lines; a data driver driving the plurality of data lines; a gate driver driving the plurality of gate lines; a panel controller controlling the data driver and the gate driver; and a PMIC outputting a first power to be supplied to the data driver, the gate driver, the display panel, or the panel controller.

The display device may further include: a power monitoring circuit determining whether or not the first power is ordinarily output from the PMIC and outputting an error detection signal indicative of an abnormality in the PMIC, wherein, when the first power is abnormal, the error detection signal is output in response to second power or a voltage corresponding to the second power; and a main controller outputting the second power to the power monitoring circuit and receiving the error detection signal from the power monitoring circuit.

According to another aspect of the present disclosure, a power monitoring circuit may include: a first input node receiving a first power output from a PMIC; a second input node receiving a second power; an error detection signal output node outputting an error detection signal indicative of an abnormality in the PMIC, depending on whether or not the first power is ordinarily input; and an error detection circuit feeding the error detection signal to the error detection signal output node, corresponding to the second power or a voltage corresponding to the second power, when the first power is abnormal.

According to another aspect of the present disclosure, a display device may include: a display panel including a plurality of data lines and a plurality of gate lines; a data driver driving the plurality of data lines; a gate driver driving the plurality of gate lines; a panel controller controlling the data driver and the gate driver; and a PMIC outputting first power to be supplied to the data driver, the gate driver, the display panel, or the panel controller.

The display device may further include a power monitoring circuit determining whether or not the first power is ordinarily output from the PMIC and outputting an error detection signal indicative of an abnormality in the PMIC, wherein, when the first power is abnormal, the error detection signal is output in response to a second power or a voltage corresponding to the second power.

According to the present disclosure, the display device and the power monitoring circuit can monitor the operating state of the PMIC supplying power required for the driving of the display panel.

In addition, according to the present disclosure, the display device and the power monitoring circuit can monitor an abnormality in the PMIC supplying power required for the driving of the display panel, even in the case in which the PMIC is in an abnormal state (e.g., a shutdown event) and the panel controller fails to recognize the abnormality in the PMIC.

BRIEF DESCRIPTION OF THE SEVERAL VIEWS OF THE DRAWINGS

The above and other objects, features and advantages of the present disclosure will be more clearly understood from the following detailed description when taken in conjunction with the accompanying drawings, in which.

DETAILED DESCRIPTION

Figure 1:
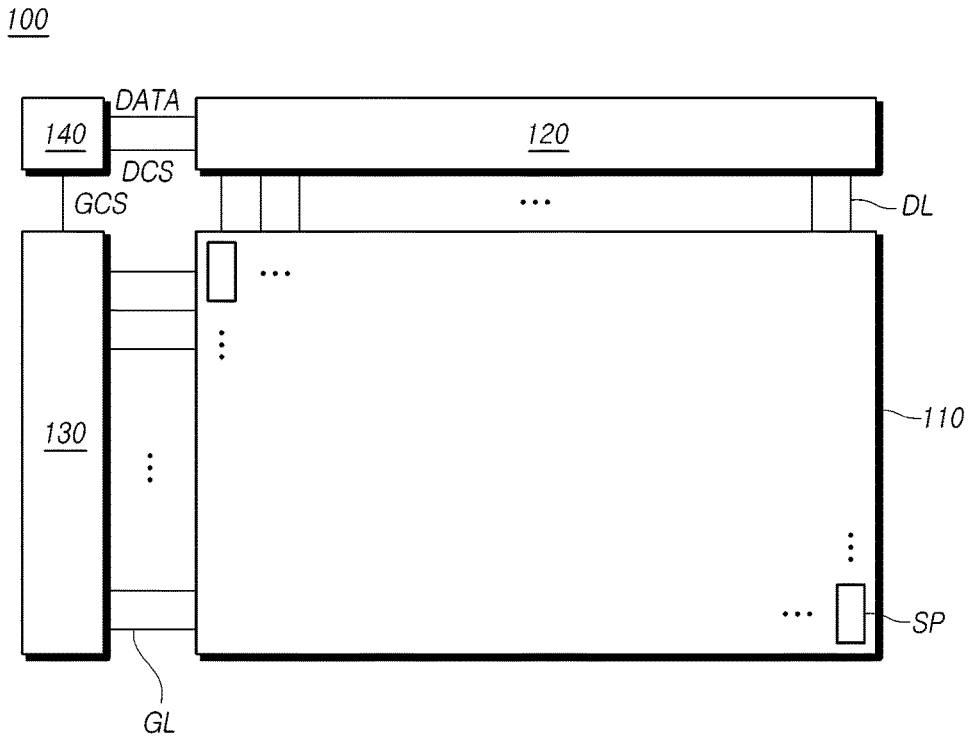
FIG. 1 is a schematic view illustrating a system configuration of an organic light-emitting display device according to example embodiments.

Hereinafter, reference will be made to embodiments of the present disclosure in detail, examples of which are illustrated in the accompanying drawings. Throughout this document, reference should be made to the drawings, in which the same reference numerals and symbols will be used to designate the same or like components. In the following description of the present disclosure, detailed descriptions of known functions and components incorporated herein will be omitted in the case that the subject matter of the present disclosure may be rendered unclear thereby.

It will also be understood that, while terms such as "first," "second," "A," "B," "(a)," and "(b)" may be used herein to describe various elements, such terms are merely used to distinguish one element from another element. The substance, sequence, order, or number of these elements is not limited by these terms. It will be understood that when an element is referred to as being "connected to" or "coupled to" another element, not only can it be "directly connected or coupled to" the other element, but it can also be "indirectly connected or coupled to" the other element via an "intervening" element. In the same context, it will be understood that when an element is referred to as being formed "on" or "under" another element, not only can it be directly formed on or under another element, but it can also be indirectly formed on or under another element via an intervening element.

FIG. 1 is a schematic view illustrating a system configuration of a display device 100 according to example embodiments.

Referring to FIG. 1, the display device 100 according to example embodiments includes a display panel 110, a data driver 120, a gate driver 130, and a panel controller 140. The display panel 110 has arrangements of a plurality of data lines DL, a plurality of gate lines GL, and a plurality of subpixels SP defined by the plurality of data lines DL and the plurality of gate lines GL.

The panel controller 140 can control the data driver 120 and the gate driver 130 by transferring a variety of control signals to the data driver 120 and the gate driver 130.

The panel controller 140 starts scanning based on timing realized in each frame, converts image data input from an external source into a data signal format readable by the data driver 120 before outputting the converted image data, and regulates data processing at suitable points in time in response to the scanning.

The panel controller 140 may be a timing controller used in the field of typical display technology or a control device performing other control functions, including the function as the timing controller.

The panel controller 140 may be embodied as a component separate from the data driver 120 or may be embodied as an integrated circuit (IC) together with the data driver 120.

The data driver 120 drives the plurality of data lines DL by supplying data voltages to the plurality of data lines DL. Herein, the data driver 120 is also referred to as a "source driver."

The data driver 120 may include one or more source driver ICs (SDICs) to drive the plurality of data lines.

Each of the SDICs may include, for example, a shift resistor, a latch circuit, a digital-to-analog converter (DAC), an output buffer, and the like.

In some cases, each of the SDICs may further include an analog-to-digital converter (ADC).

The gate driver 130 sequentially drives the plurality of gate lines GL by sequentially transferring scanning signals to the plurality of gate lines GL. Herein, the gate driver 130 is also referred to as a "scanning driver."

The gate driver 130 may include one or more gate driver ICs (GDICs).

Each of the GDICs may include, for example, a shift resistor, a level shifter, and the like.

The gate driver 130 sequentially transfers scanning signals respectively having an on or off voltage to the plurality of gate lines GL, under the control of the controller 140.

When a specific gate line among the plurality of gate lines GL is opened by the gate driver 130, the data driver 120 converts image data received from the controller 140 to analog data voltages and then supplies the analog data voltages to the plurality of data lines DL.

The data driver 120 may be located on one side of (e.g., above or below) the display panel 110, as illustrated in FIG. 1. Alternatively, the data driver 120 may be located on both sides of (e.g., above and below) the display panel 110, depending on the driving system, the design of the panel, or the like.

The gate driver 130 may be located on one side (e.g., to the right of left) of the display panel 110, as illustrated in FIG. 1. Alternatively, the gate driver 130 may be located on both sides (e.g., to the right and left) of the display panel 110, depending on the driving system, the design of the panel, or the like.

The panel controller 140 receives a variety of timing signals, including a vertical synchronization (Vsync) signal, a horizontal synchronization (Hsync) signal, an input data enable (DE) signal, and a clock signal, together with input image data, from an external source (e.g., a host system).

The panel controller 140 receives a variety of timing signals, including a Vsync signal, an Hsync signal, an input DE signal, and a clock signal, generates a variety of control signals, and outputs the variety of control signals to the data driver 120 and the gate driver 130 to control the data driver 120 and the gate driver 130.

For example, the panel controller 140 outputs a variety of gate control signals (GCSs), including a gate start pulse (GSP), a gate shift clock (GSC), and a gate output enable (GOE) signal, to control the gate driver circuit 130.

Among these signals, the GSP controls the operation start timing of one or more GDICs of the gate driver 130. The GSC is a clock signal commonly input to the one or more GDICs to control the shift timing of a scanning signal (or a gate pulse). The GOE signal designates the output timing information of the one or more GDICs.

In addition, the panel controller 140 outputs a variety of data control signals (DCSs), including a source start pulse (SSP), a source sampling clock (SSC), and a source output enable (SOE) signal, to control the data driver 120.

Among these signals, the SSP controls the data sampling start timing of one or more SDICs of the data driver 120. The SSC is a clock signal controlling the data sampling timing of each of the SDICs. The SOE signal controls the output timing of the data driver 120.

The display device 100 according to example embodiments may be one of various types of display, such as a liquid crystal display (LCD) device, an organic light-emitting display device, and a plasma display device.

The structure of each of the plurality of subpixels SP arranged in the display panel 110 may vary depending on the type of the display device 100 according to example embodiments.

For example, when the display device 100 according to example embodiments is an organic light-emitting display device, each of the subpixels SP arranged in the display panel 110 may include an organic light-emitting diode (OLED) that is a self-luminous element, a driving transistor driving the OLED, and the like.

The types and number of circuit elements of each subpixel SP may be variously determined, depending on the function and design of the subpixel.

Hereinafter, the structure of each of the subpixels SP arranged in the display panel 110 in the case in which the display device 100 according to example embodiments is an organic light-emitting display device will be described by way of example with reference to FIGS. 2 and 3.

Figure 2:
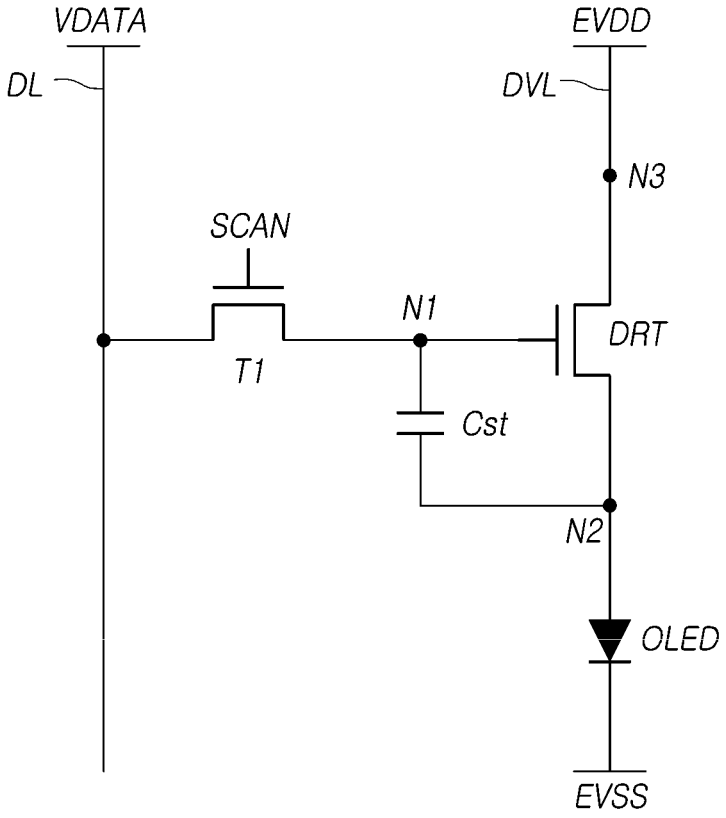
FIG. 2 is a circuit diagram illustrating an example subpixel structure of the organic light-emitting display device according to example embodiments.

FIG. 2 is a circuit diagram illustrating an example subpixel structure of the organic light-emitting display device 100 according to example embodiments.

Referring to FIG. 2, in the display device 100 according to example embodiments, each of the subpixels SP basically includes an OLED, a driving transistor DRT driving the OLED, a first transistor T1 transferring a data voltage to a first node N1 of the driving transistor DRT corresponding to a gate node, and a storage capacitor Cst maintaining a data voltage corresponding an image signal voltage or a voltage corresponding to the data voltage for a period of a single frame.

The OLED includes a first electrode (e.g., an anode or a cathode), an organic layer, a second electrode (e.g., a cathode or an anode), and the like.

A base voltage EVSS is applied to the second electrode of the OLED.

The driving transistor DRT drives the OLED by supplying driving current to the OLED.

The driving transistor includes a first node N1, a second node N2, and a third node N3.

The first node N1 of the driving transistor DRT corresponds to the gate node and is electrically connected to a source node or a drain node of the first transistor T1.

The second node N2 of the driving transistor DRT is a source node or a drain node electrically connected to a first electrode of the OLED.

The third node N3 of the driving transistor DRT is a drain node or a source node, to which a driving voltage EVDD is applied, and is electrically connected to a driving voltage line DVL, through which the driving voltage EVDD is supplied.

The first transistor T1 is electrically connected between a data line DL and the first node N1 of the driving transistor DRT, and is controlled by a scanning signal SCAN applied to a gate node through a gate line.

The first transistor T1 can be turned on by a scanning signal SCAN to transfer a data voltage VDATA, supplied from the data line DL, to the first node N1 of the driving transistor DRT.

The storage capacitor Cst is electrically connected between the first node N1 and the second node N2 of the driving transistor DRT.

Figure 3:
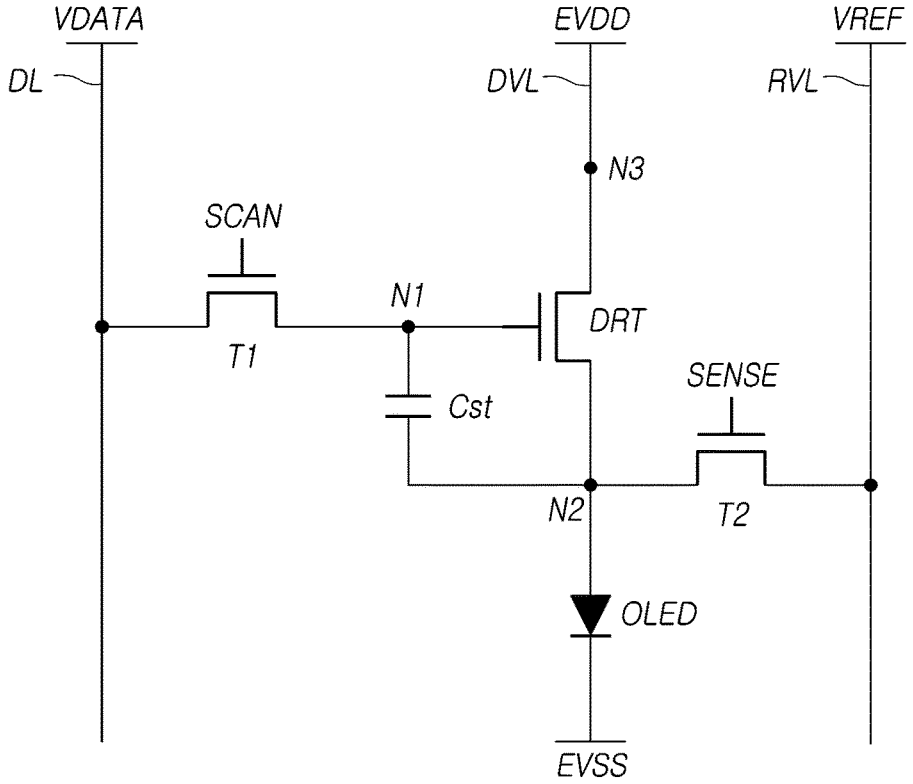
FIG. 3 is a circuit diagram illustrating another example subpixel structure of the organic light-emitting display device according to example embodiments.

FIG. 3 is a circuit diagram illustrating another example subpixel structure of the organic light-emitting display device 100 according to example embodiments.

Referring to FIG. 3, each of the subpixels arranged in the display panel 110 according to example embodiments further includes, for example, a second transistor T2, in addition to the OLED, the driving transistor DRT, the first transistor T2, and the storage capacitor Cst.

Referring to FIG. 3, the second transistor T2 is electrically connected between the second node N2 of the driving transistor DRT and a reference voltage line RVL, through which a reference voltage VREF is supplied. The second transistor T2 is controlled by a sensing signal SENSE, i.e., a type of scanning signal, applied to a gate node.

Since the second transistor T2 is further included, the voltage state of the second node N2 of the driving transistor DRT in the subpixel SP can be more effectively controlled.

The second transistor T2 is turned on by the sensing signal SENSE to transfer the reference voltage VREF, supplied through the reference voltage line RVL, to the second node N2 of the driving transistor DRT.

The second transistor T2 may also be used as a voltage sensing path for the second node N2 of the driving transistor DRT.

The scanning signal SCAN and the sensing signal SENSE may be separate gate signals. In this case, the scanning signal SCAN and the sensing signal SENSE can be applied to the gate node of the first transistor T1 and the gate node of the second transistor T2 through different gate lines, respectively.

In some cases, the scanning signal SCAN and the sensing signal SENSE may be the same gate signals. In this case, the scanning signal SCAN and the sensing signal SENSE can be commonly applied to the gate node of the first transistor T1 and the gate node of the second transistor T2 through the same gate line.

Referring to FIGS. 2 and 3, the driving transistor DRT, the first transistor T1, and the second transistor T2 may each be an n-transistor or a p-transistor.

Referring to FIGS. 2 and 3, the storage capacitor Cst is an external capacitor intentionally designed to be outside of the driving transistor DRT, instead of being a parasitic capacitor (e.g., Cgs or Cgd), i.e., an internal capacitor, present between the first node N1 and the second node N2 of the driving transistor DRT.

Figure 4:
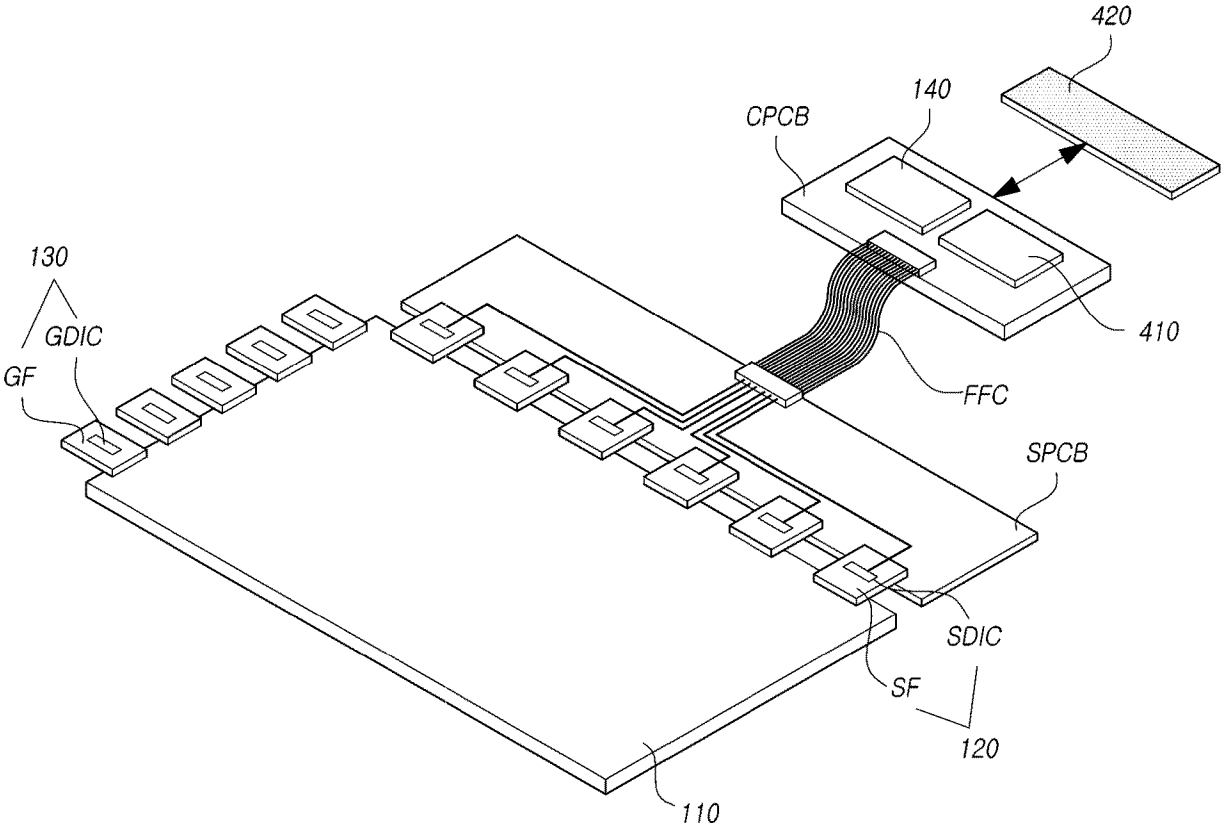
FIG. 4 is a perspective view illustrating an example system of the organic light-emitting display device according to example embodiments.

FIG. 4 is a perspective view illustrating an example system of the display device 100 according to example embodiments.

The data driver 120 may include one or more SDICs to drive the plurality of data lines.

The SDICs may be connected to the bonding pads of the display panel 110 by tape-automated bonding (TAB) or a chip-on-glass (COG) method, may be directly mounted on the display panel 110, or in some cases, may be integrated with the display panel 110.

The SDICs may also be implemented as chip-on-film (COF) SDICs, which are mounted on films SF connected to the display panel 110.

The gate driver 130 includes one or more GDICs.

The GDICs may be connected to the bonding pads of the display panel 110 by tape-automated bonding (TAB) or a chip-on-glass (COG) method, may be implemented as gate-in-panel (GIP) GDICs, which are directly included in, e.g., mounted on, the display panel 110, or in some cases, may be integrated with the display panel 110.

The GDICs may also be implemented as chip-on-film (COF) GDICs, which are included in, e.g., mounted on or integrated with, films GF connected to the display panel 110.

The display device 100 according to example embodiments further includes at least one source printed circuit board (SPCB) providing circuit connections to the one or more SDICs and a control printed circuit board (CPCB) on which control components and a variety of electrical devices are mounted.

The one or more SDICs are directly included in, e.g., mounted on, the at least one SPCB or the film SF, in which the one or more SDICs are included, is connected to the at least one SPCB.

The panel controller 140, a power management IC (PMIC) 410, and the like, are included in, e.g., mounted on, the CPCB. The panel controller 140 controls the operations of the data driver 120 and the gate driver 130. The PMIC 410 supplies a variety of voltages or currents to the display panel 110, the data driver 120, the gate driver 130, and the like or controls the variety of voltages or currents to be supplied.

The circuit of the at least one SPCB may be connected to the circuit of the CPCB via at least one connecting member.

The connecting member may be a flexible printed circuit (FPC), a flexible flat cable (FFC), or the like.

The at least one SPCB and the CPCB may be integrated into a single PCB.

The panel controller 140 may be integrated with the SDICs.

Referring to FIG. 4, the display device 100 according to example embodiments further includes a main controller 420 controlling the entirety of components, including a display module comprised of the display panel 110, the driver circuits 120 and 130, and the panel controller 140.

Figure 5:
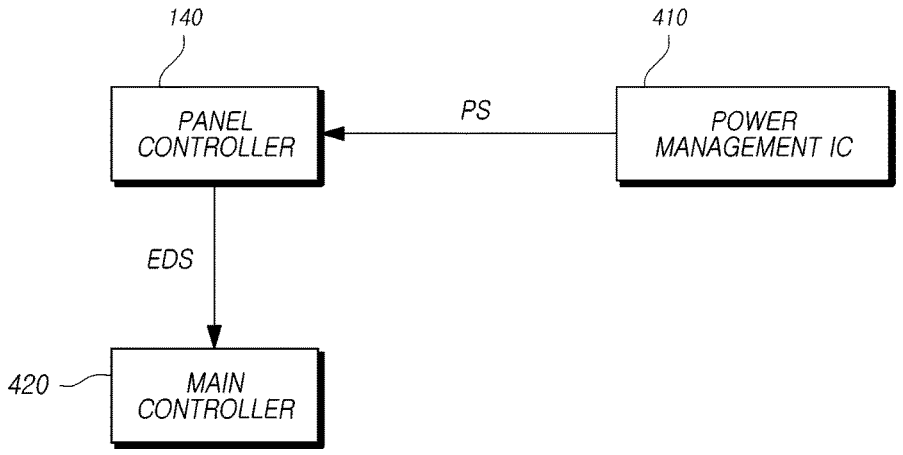
FIG. 5 is a block diagram illustrating a panel controller, a main controller, and a PMIC of the organic light-emitting display device according to example embodiments.
Figure 6:
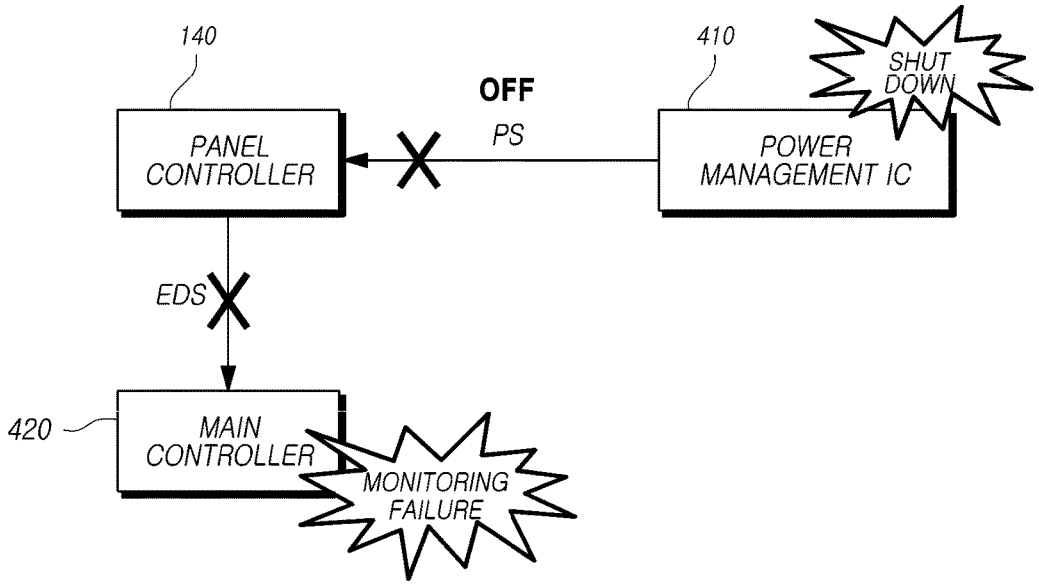
FIG. 6 is a block diagram illustrating a case in which the PMIC is shut down in the organic light-emitting display device.

FIG. 5 is a block diagram illustrating, the panel controller 140, the main controller 420, and the PMIC 410 of the organic light-emitting display device 100 according to example embodiments, while FIG. 6 is a block diagram illustrating a case in which the PMIC 410 is shut down in the organic light-emitting display device 100.

Referring to FIG. 5, the display device 100 according to example embodiments is configured such that the PMIC 410 collectively outputs a variety of voltages and currents to be input to the panel controller 140 in order to reduce power blocks within the CPCB.

Referring to FIGS. 5 and 6, in the event of a problem, the panel controller 140 outputs an error detection signal EDS to the main controller 420.

For example, when the PMIC is shut down by overcurrent or excess current in, for example, gate voltages VGH and VGL, operating power PS to be used by the panel controller 140 may be in an off state. In this case, the display panel 110 in which overcurrent in the gate voltages VGH and VGL occurs may be burnt.

When the operating power PS to be used by the panel controller 140 is in the off state, the panel controller 140 cannot output the error detection signal EDS.

Then, even in the case in which the PMIC 410 has an abnormality, the main controller 420 does not receive the error detection signal EDS from the panel controller 140. Thus, the main controller 420 cannot deal with the abnormality in the PMIC 410, thereby failing to prevent the display panel 110 from being burnt.

Accordingly, example embodiments provide a circuit that can detect the shutdown of the PMIC 410 even in the case in which the operating power PS of the panel controller 140 is in the off state.

Hereinafter, a PMIC abnormality detecting circuit in the display device 100 according to example embodiments will be described with reference to FIG. 7, and an inner circuit of the PMIC abnormality detecting circuit will be described in greater detail with reference to FIGS. 8 to 10.

Figure 7:
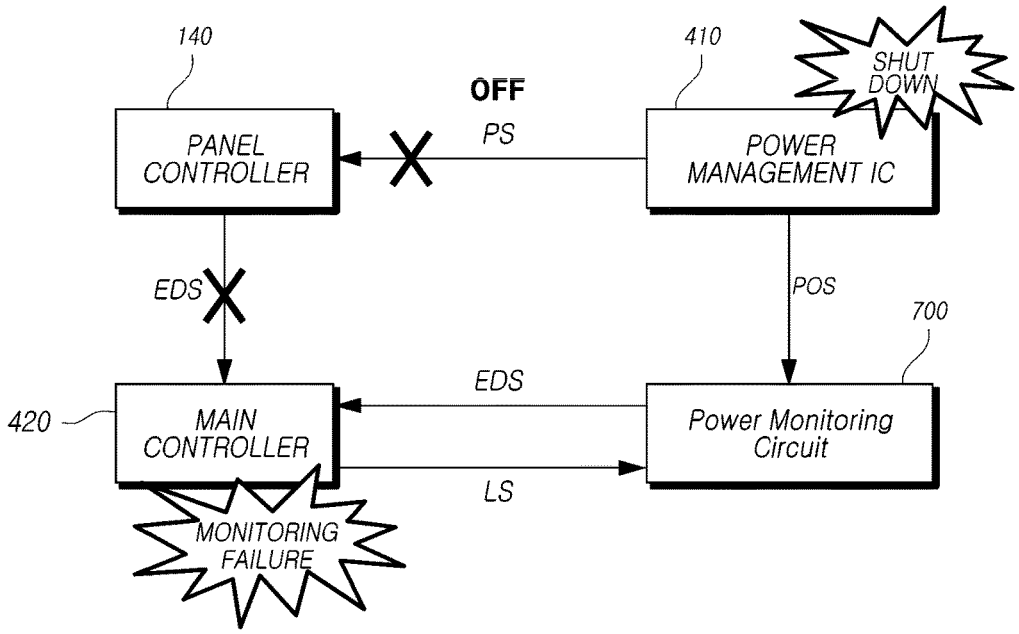
FIG. 7 is a block diagram illustrating a PMIC abnormality detecting circuit in the organic light-emitting display device according to example embodiments.

FIG. 7 is a block diagram illustrating the PMIC abnormality detecting circuit in the organic light-emitting display device 100 according to example embodiments, the PMIC abnormality detecting circuit being able to detect an abnormality (e.g., a shutdown event) in the PMIC 410.

Referring to FIGS. 1 and 7 together, the display device 100 according to example embodiments includes a display panel 110 having the arrangements of the plurality of data lines DL and the plurality of gate lines GL, the data driver 120 driving the plurality of data lines DL, the gate driver 130 driving the plurality of gate lines GL, and the panel controller 140 controlling the data driver 120 and the gate driver 130.

The display device 100 according to example embodiments also includes the PMIC 410 outputting first power POS, e.g., a voltage or a current, to be supplied to the data driver 120, the gate driver 130, the display panel 110, or the panel controller 140.

The display device 100 according to example embodiments further includes a power monitoring circuit 700. The power monitoring circuit 700 monitors the first power POS output from the PMIC 410, and when a shutdown event in the PMIC 410 is detected based on the result of monitoring, outputs an error detection signal EDS.

The power monitoring circuit 700 determines whether or not the first POS is ordinarily output from the PMIC 410 and outputs the error detection signal EDS indicative of an abnormality in the PMIC 410.

The power monitoring circuit 700 can detect an abnormality (e.g., a shutdown event) in the PMIC 410 by determining a case in which the first power POS is not output from the PMIC 410 or a case in which the first POS output from the PMIC 410 is abnormal (e.g., the first power POS differs from the corresponding voltage value or is excessively lower or higher than the corresponding voltage value) and output the error detection signal EDS.

More specifically, for example, the power monitoring circuit 700 can detect the shutdown event in the PMIC 410 by receiving second power LS, different from the first power POS, and determining whether or not the first power POS is being ordinarily output from the PMIC 410 using the second power LS.

When the first power POS output from the PMIC 410 is abnormal, the power monitoring circuit 700 can output the error detection signal EDS in response to the second power LS or a voltage corresponding to the second power LS.

Referring to FIG. 7, the main controller 420 can output the second power LS to the power monitoring circuit 700, and the main controller 420 can receive the error detection signal EDS from the power monitoring circuit 700.

The PMIC abnormality detecting circuit can be used to detect an abnormality (e.g., a shutdown event) in the PMIC 410 by determining whether or not the first power POS is ordinarily output from the PMIC 410. Thus, the main controller 420 can perform a countermeasure (e.g., a power failure control measure) to the abnormality (e.g., a shutdown event) in the PMIC 410, thereby preventing further problems, such as panel burning, that would otherwise be caused by the abnormality (e.g., a shutdown event) in the PMIC 410.

Referring to FIG. 7, the panel controller 140 controls the operation of the display panel 110 using the operating power PS output from the PMIC 410.

When an abnormality occurs in the PMIC 410, even in the case the panel controller 140 fails to output the error detection signal EDS due to the operating power PS being in the off state, the power monitoring circuit 700 can determine that the operating state of the panel controller 140 is abnormal and output the error detection signal EDS to the main controller 420. That is, the power monitoring circuit 700 may operate separately than the panel controller 140.

As described above, even in the case in which the abnormality in the PMIC 410 is not detected by the panel controller 140, since the operating power PS of the panel controller 140 is in the off state due to the abnormality in the PMIC 410, the main controller 420 can detect the abnormality in the PMIC 410 using the power monitoring circuit 700.

The first power POS output from the PMIC 410 and monitored by the power monitoring circuit 700 may be, for example, a gate driving voltage VHG or VGL that the PMIC 410 supplies to the gate driver 130.

When the gate driving voltage, e.g., VHG or VGL, is not output from the PMIC 410, the gate driver 130 cannot perform gate driving, thereby failing to perform an image display function.

In addition, when the gate driving voltage, e.g., VHG or VGL, is output as an abnormal value from the PMIC 410, gate driving is not ordinarily performed by the gate driver 130, so that the image display function is not ordinarily performed. Then, a screen error may occur or overcurrent may flow through the display panel 110, thereby burning the display panel 110 or an associated circuit.

Thus, the power monitoring circuit 700 can prevent abnormalities associated with gate driving or a burning event caused by overcurrent by monitoring the gate driving voltage, e.g., VHG or VGL, output from the PMIC 410 to be used as the first power POS in gate driving.

Alternatively or additionally, the first power POS output from the PMIC 410 and monitored by the power monitoring circuit 700 may be power supplied to the data driver 120 or the display panel 110 or a voltage supplied to a memory, e.g., a double data rate (DDR) memory.

The power supplied to the data driver 120 or the display panel 110 may be, for example, a reference voltage VREF, a driving voltage EVDD, or the like.

As described above, the power monitoring circuit 700 can prevent abnormalities associated with the data driver 120 by monitoring the power output by the PMIC 410 to be used as the first power POS in the operation of the data driver 120 or the power, e.g., VREF or EVDD, supplied to the display panel 110 through the data driver 120.

In addition, the power monitoring circuit 700 can prevent abnormalities in the operation of the memory and resultant screen errors by monitoring the power of the memory output from the PMIC 410 as the first power POS.

Figure 8:
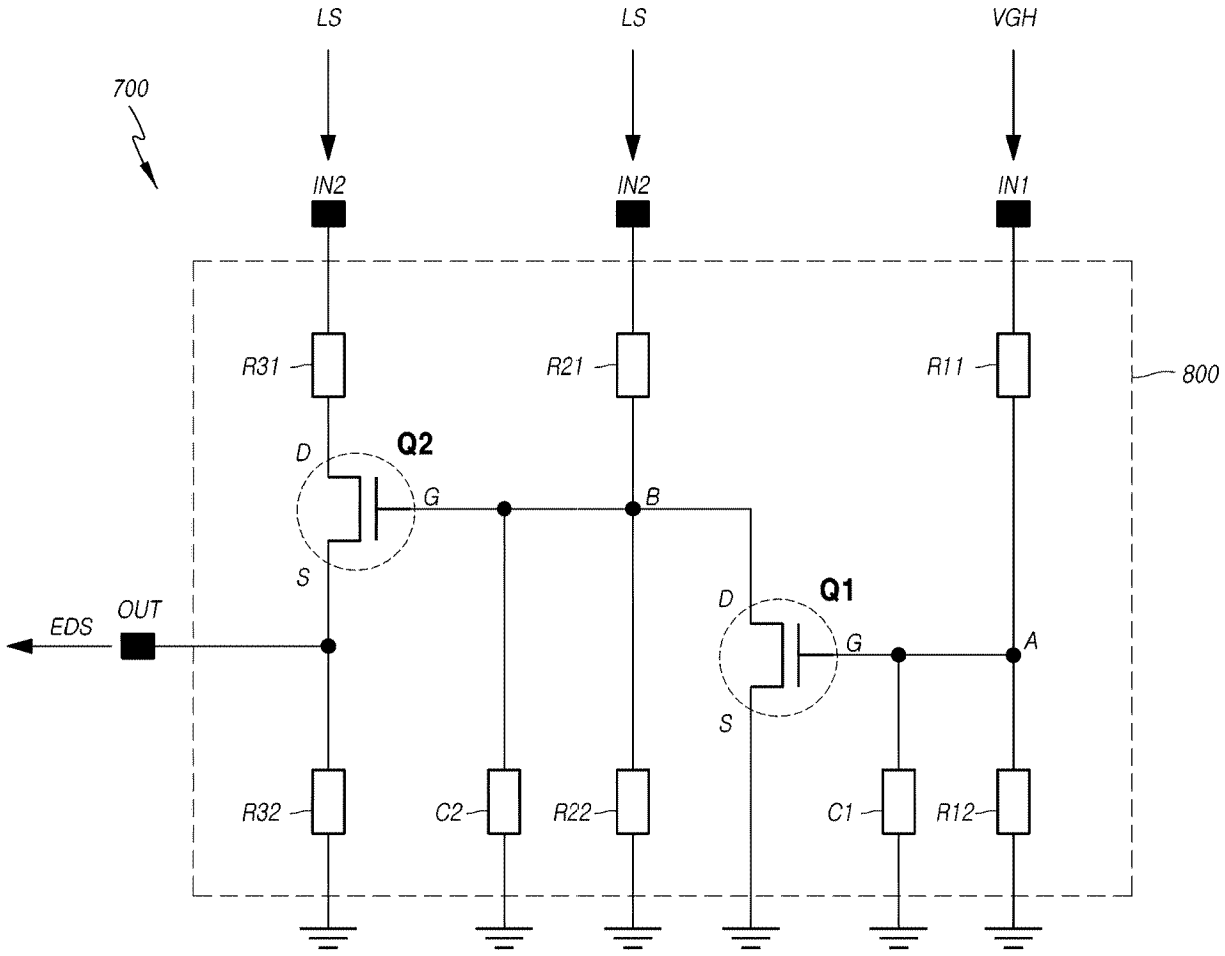
FIG. 8 is a circuit diagram illustrating a power monitoring circuit in the PMIC abnormality detecting circuit according to example embodiments.
Figure 9:
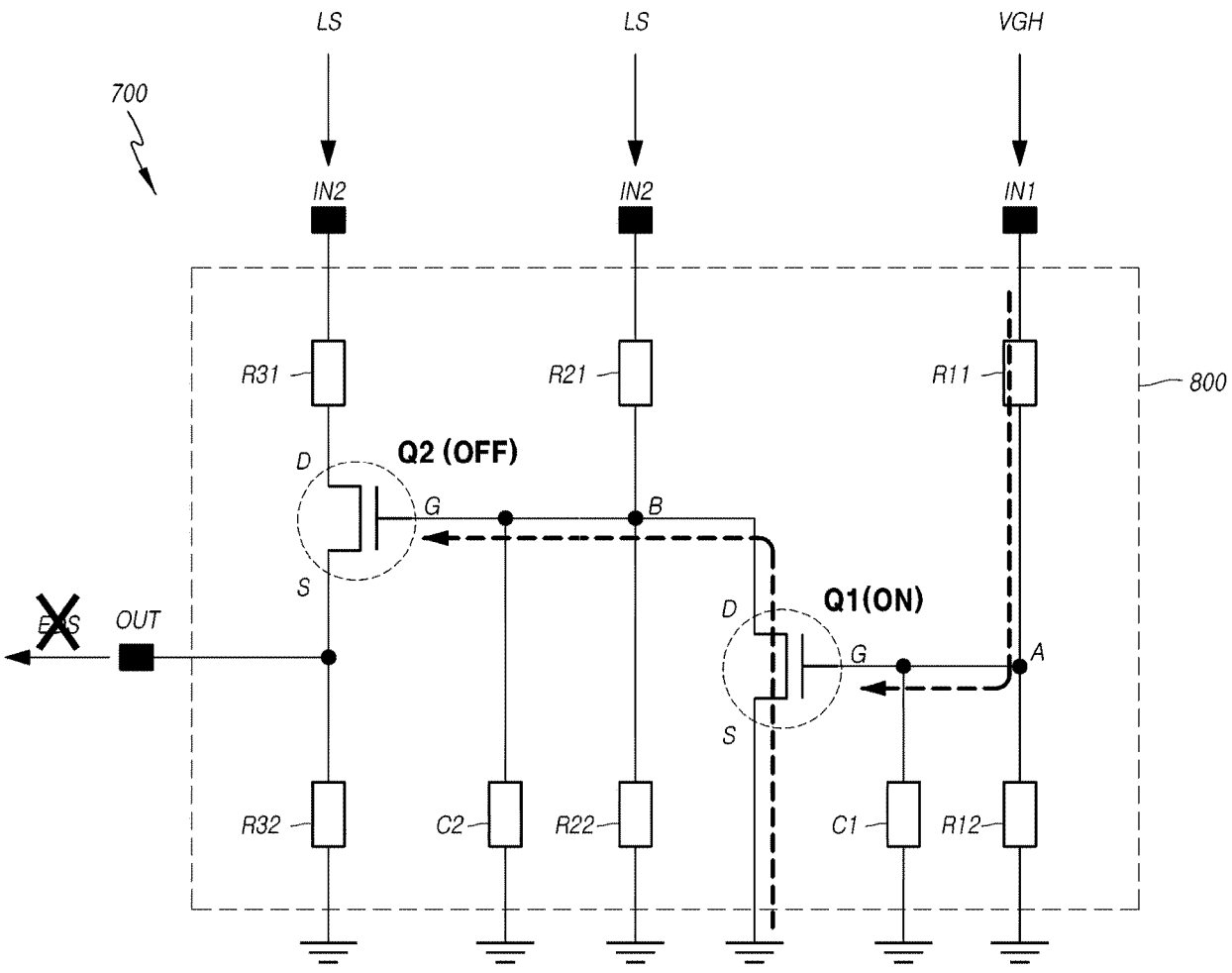
FIG. 9 is a circuit diagram illustrating an operating state of the power monitoring circuit in a case in which the PMIC is not shut down.
Figure 10:
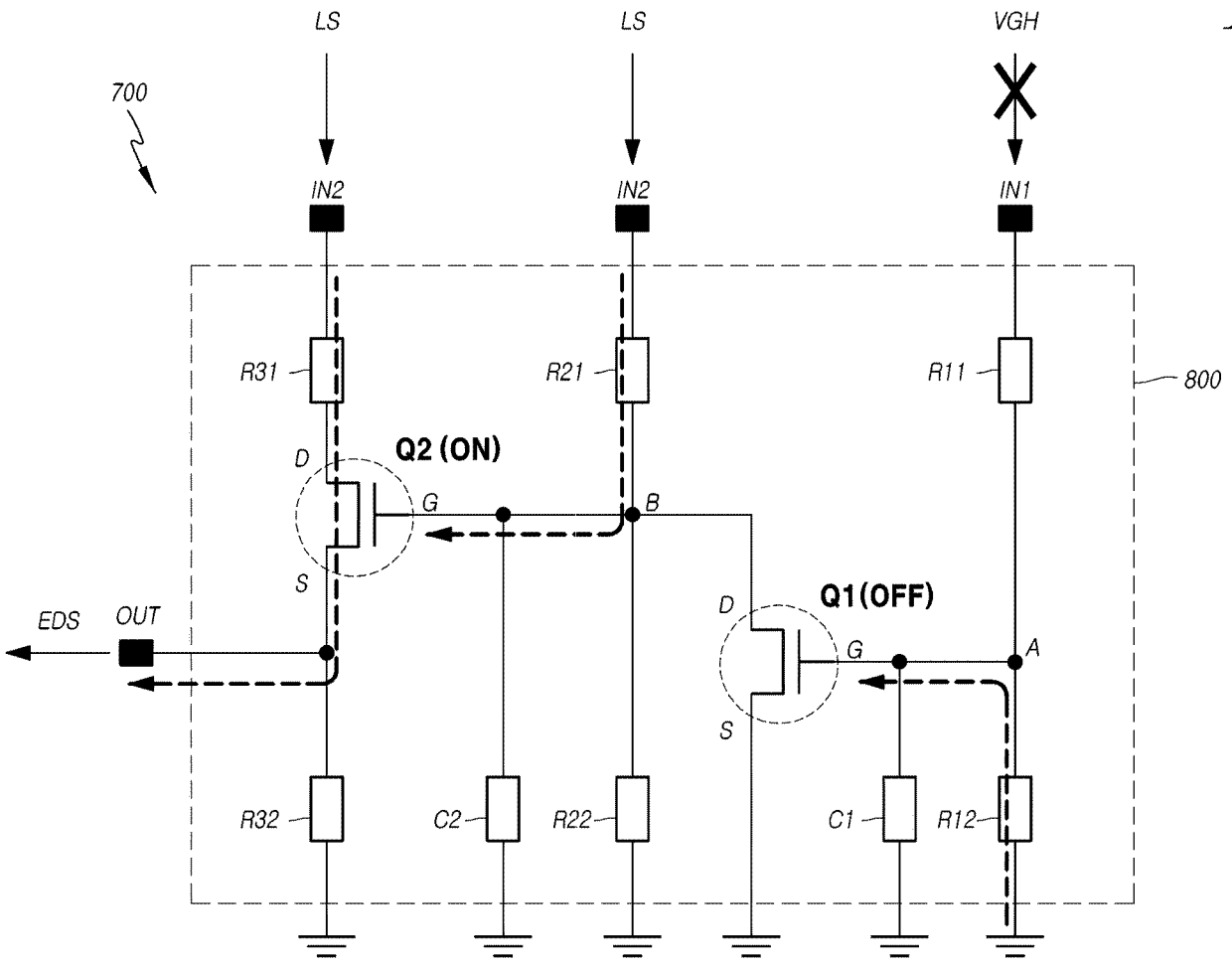
FIG. 10 is a circuit diagram illustrating an operating state of the power monitoring circuit in a case in which the PMIC is shut down.

FIG. 8 is a circuit diagram illustrating the power monitoring circuit 700 in the PMIC abnormality detecting circuit according to example embodiments, FIG. 9 is a circuit diagram illustrating an operating state of the power monitoring circuit 700 in a case in which the PMIC 500 is not shut down, and FIG. 10 is a circuit diagram illustrating an operating state of the power monitoring circuit 700 in a case in which the PMIC 500 is shut down.

In FIGS. 8 to 10, it should be understood that a first power POS output from the PMIC 410 is taken as a high-level gate voltage VGH, a type of gate voltage, as an illustrative example.

Referring to FIG. 8, the power monitoring circuit 700 includes a first switching element Q1 and a second switching element Q2. The first switching element Q1 has a gate node G connected to a first power POS output point of the PMIC 410. The first switching element Q1 is on-off controlled depending on whether or not the first power POS is ordinarily input. The switching operation of the second switching element Q2 is controlled in response to the first switching element Q1 being on-off controlled. The second switching element Q2 has second power LS input to a drain node D (or a source node S), and when turned on, outputs an error detection signal EDS to the source node S (or the drain node D).

When the first switching element Q1 is turned on, the second switching element Q2 can be turned off so as not to output the error detection signal EDS.

When the first switching element Q1 is turned off, the second switching element Q2 can be turned on to output the error detection signal EDS to the source node S (or the drain node D), in response to the second power LS input to the drain node D (or the source node S) or a voltage corresponding to the second power LS.

As described above, due to the two switching elements Q1 and Q2 used herein, it is possible to provide a simple circuit that can easily and accurately monitor whether or not the first power POS (e.g., a high-level gate voltage VGH) is ordinarily output from the PMIC 410, and based on the result of monitoring, output the error detection signal EDS.

Referring to FIGS. 8 and 9, when the PMIC 410 ordinarily operates, for example, when the PMIC 410 is not shut down, the first power POS, e.g., VGH, or the voltage corresponding to the first power (e.g., a voltage at point A, divided by resistors R11 and R12) is input to the gate node G of the first switching element Q1, which meets a threshold to switch on the first switching element Q1, so that the first switching element Q1 can be turned on.

When the first switching element Q1 is turned on, a base voltage, e.g., a ground voltage, input to the source node S (or the drain node D) of the first switching element Q1 is input to the gate node G of the second switching element Q2, causing the second switching element Q2 to be turned off.

Referring to FIGS. 8 and 10, when the PMIC 410 abnormally operates, for example, when the PMIC 410 is shut down, the first power POS, e.g., VGH, or the voltage corresponding to the first power (e.g., a voltage at point A, distributed by resistors) is not input or is abnormally input to the gate node G of the first switching element Q1, i.e., the first power POS does not meet the threshold to switch on the first switching element Q1, so that the first switching element Q1 can be turned off. It should be appreciated that the threshold voltage to switch on the first switching element Q1 may include a range of voltages and a voltage outside the threshold range, either higher or lower, may not properly switch on the first switching element Q1.

When the first switching element Q1 is turned off, second power LS or a voltage corresponding to the second power (e.g., a voltage at point B, distributed by resistors) is input to the gate node G of the second switching element Q2, so that the second switching element Q2 can be turned on.

The first power POS may be a turn-on level voltage of the first switching element Q1, such that the two switching elements Q1 and Q2 can operate in the above-described manner, depending on the output state of the first power POS, e.g., VGH, from the PMIC 410. The second power LS may be a turn-on level voltage of the second switching element Q2. The base voltage, e.g., a ground voltage, may be a turn-off level voltage of the second switching element Q2.

For example, the first power POS may be a gate voltage VGH or VHGL supplied to the gate driver 130, power, e.g., VREF or EVDD, supplied to the data driver 120, memory operating power, or the like. The second power LS may be logic power.

As described above, it is possible to provide a circuit that can control the operating states of the two switching elements Q1 and Q2 in response to the first power POS, e.g., VGH, output from the PMIC 410 and the second power LS output from the main controller 420, so that the error detection signal EDS can be output depending on whether or not the first power POS, e.g., a high-level gate voltage VGH, is normally output from the PMIC 410.

The power monitoring circuit 700 described above will be described in greater detail with reference to FIGS. 8 to 10. In FIGS. 8 to 10, the two switching elements Q1 and Q2 will be taken as n-type switching elements (e.g., transistors).

The power monitoring circuit 700 includes a first input node IN1, a second input node IN2, an error detection signal output node OUT, and an error detection circuit 800. The first input node IN1 receives first power POS output from the PMIC 410. The second input node IN2 receives second power LS. The error detection signal output node OUT outputs an error detection signal EDS indicative of an abnormality in the PMIC 410, depending on whether or not the first power POS is ordinarily input. When the first power POS is abnormal, the error detection circuit 800 outputs the error detection signal EDS, corresponding to the second power LS or a voltage corresponding to the second power LS.

The use of the power monitoring circuit 700 makes it possible to monitor whether or not the first power POS output from the PMIC 410, which supplies power required for the driving of the display panel 110, is abnormal.

The error detection circuit 800 within the power monitoring circuit 700 includes a first switching element Q1 and a second switching element Q2.

The first switching element Q1 has the gate node G electrically connected to the first input node IN1, the drain node D (or the source node S) electrically connected to the second input node IN2, and the source node S (or the drain node D) electrically connected to a base voltage node Ground.

The second switching element Q2 has a gate node G electrically connected to the drain node D (or the source node S) of the first switching element Q1, a drain node D (or a source node S) electrically connected to the second input node IN2, and the source node S (or the drain node D) electrically connected to the error detection signal output node OUT.

As described above, when the first power POS, e.g., a high-level gate voltage VGH, is abnormally output from the PMIC 410, depending on the output status of the first power POS, e.g., a high-level gate voltage VGH, in the PMIC 410, the error detection circuit 800 allows the error detection signal EDS to be output. The error detection circuit 800 can be embodied as a simple circuit using the two switching elements Q1 and Q2.

The first power POS input to the first input node IN1 may be a voltage higher than the maximum allowable voltage of the first switching element Q1.

In this case, the first switching element Q1 may not perform an ordinary switching function.

Thus, when the first power POS input to the first input node IN1 is a voltage higher than the maximum allowable voltage of the first switching element Q1, two resistors R11 and R12 are connected in series between the first input node IN1 and the base voltage node Ground.

The gate node of the first switching element Q1 is connected to point A at which the two resistors R11 and R12 are connected.

Thus, a voltage lower than the voltage of the first power POS (i.e., a voltage equal to or lower than the maximum allowable voltage of the switching element Q1) can be applied to the gate node of the first switching element Q1, in response to voltage splitting/division by the two resistors R11 and R12.

As described above, even in the case in which the first power POS used in the display device 100 is higher than the maximum allowable voltage of the first switching element Q1, the first switching element Q1 allows an ordinary switching operation to be performed. Thus, a PMIC shutdown event can be ordinarily detected.

A first capacitor C1 is connected between the gate node and the base voltage node Ground of the first switching element Q1.

The second power, possibly logic power, input to the second input node IN2 may be a voltage higher than the maximum allowable voltage of the second switching element Q2.

In this case, the second switching element Q2 may not perform an ordinary switching operation.

Thus, when the second power LS input at the second input node IN2 is a voltage higher than the maximum allowable voltage of the second switching element Q2, two resistors R21 and R22 are connected in series between the second input node IN2 and a base voltage node Ground.

The drain node D of the first switching element Q1 and the gate node G of the second switching element Q2 are connected to point B at which the two resistors R21 and R22 are connected.

Thus, as the voltage is split/divided by the two resistors R21 and R22, a voltage lower than the voltage of the second power LS (i.e., a voltage equal to or lower than the maximum allowable voltage of the second switching element Q2) can be applied to the gate node of the second switching element Q2.

As described above, when the second power LS used in the display device 100 is higher than the maximum allowable voltage of the second switching element Q2, voltage divider circuits of R21, R22 allows the ordinary switching operation of the second switching element Q2 to be performed. Thus, a PMIC shutdown event can be ordinarily detected.

A second capacitor C2 is connected between the gate node G of the second switching element Q2 and the base voltage node Ground.

The error detection signal EDS output to the error detection signal output node OUT may be a voltage higher than the maximum allowable voltage of the main controller 420 to which the error detection signal EDS is input.

In this case, the main controller 420 may not ordinarily recognize the error detection signal EDS.

Thus, when the error detection signal EDS output from the error detection signal output node OUT is a voltage higher than the maximum allowable voltage of the main controller 420, the second input node IN2 and the drain node D (or the source node S) of the second switching element Q2 are connected via a resistor R31.

In addition, a resistor R32 is connected between the source node S (or the drain node D) and the base voltage node Ground of the second switching element Q2. Thus, when the second switching element Q2 is turned on, resistors R31 and R32 function as a voltage divider.

Thus, the error detection signal EDS output from the source node S (or the drain node D) of the second switching element Q2 through the error detection signal output node OUT may be logic power having a voltage lower than that of the second power LS (i.e., a voltage equal to or lower than the maximum allowable voltage of the main controller 420).

In an example, the power monitoring circuit 700 may be used to monitor different first power POS output of the power management IC 410 and the different first power POS may have different, e.g., voltage values. Error detection circuit 800 may include multiple different voltage divider elements (e.g., with different voltage split ratios), all configured to be connectable between the gate node G of the first switching element Q1 and the first input node IN1 (or multiple different first input nodes IN1*s*). And based on the different first power POS to be received at first input node IN1, the gate node G of the first switching element Q1 may be connected to first input node IN1 via different voltage divider elements or via no voltage divider element. It is also possible that one or both of resistors R11 and R12 may include controllably variable resistance values and may provide variable voltage split ratio for different first power POS values to be received at the first input node IN1.

Similar description also applies to voltage divider elements R21/R22 and R31/R32. For example gate node G of the second switching element Q2 may be connected to the second input node IN2 via different voltage divider elements (e.g., with different voltage split ratios) or via no voltage divider element.

As described above, the voltage of the error detection signal EDS output from the second switching element Q2, lower than that of the second power LS, corresponds to a voltage equal to or lower than the maximum allowable voltage of the main controller 420. This can consequently prevent the main controller 420 from failing to recognize or erroneously recognizing the error detection signal EDS, so that the shutdown event of the PMIC 410 can be accurately detected.

The power monitoring circuit 700 as described above can be provided in the CPCB, the SPCB, or the like.

As set forth above, according to example embodiments, the display device 100 and the power monitoring circuit 700 can monitor the operating state of the PMIC 410 supplying power required for the driving of the display panel 110.

In addition, according to example embodiments, the display device 100 and the power monitoring circuit 700 can monitor an abnormality in the PMIC 410 supplying power required for the driving of the display panel 110, even in the case in which the PMIC 410 is in an abnormal state (e.g., a shutdown event) and the panel controller 140 fails to recognize the abnormality in the PMIC 410.

The foregoing descriptions and the accompanying drawings have been presented in order to explain the certain principles of the present disclosure. A person skilled in the art to which the present disclosure relates could make many modifications and variations by combining, dividing, substituting for, or changing the elements without departing from the principle of the present disclosure. The foregoing embodiments disclosed herein shall be interpreted as illustrative only but not as limitative of the principle and scope of the present disclosure. It should be understood that the scope of the present disclosure shall be defined by the appended Claims and all of their equivalents fall within the scope of the present disclosure.

The various embodiments described above can be combined to provide further embodiments. All of the U.S. patents, U.S. patent application publications, U.S. patent applications, foreign patents, foreign patent applications and non-patent publications referred to in this specification and/or listed in the Application Data Sheet are incorporated herein by reference, in their entirety. Aspects of the embodiments can be modified, if necessary to employ concepts of the various patents, applications and publications to provide yet further embodiments.

These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

What is claimed is:

1. A display device comprising:

a display panel including a plurality of data lines and a plurality of gate lines;

a data driver configured to drive the plurality of data lines;

a gate driver configured to drive the plurality of gate lines;

a panel controller configured to control the data driver and the gate driver;

a power management integrated circuit configured to output a first power to be supplied to the data driver, the gate driver, the display panel, or the panel controller;

a power monitoring circuit configured to determine whether or not the first power output from the power management integrated circuit meets a threshold and to output an error detection signal indicative of an abnormality in the power management integrated circuit when the first power does not meet the threshold, the error detection signal being output in response to a second power, wherein the power monitoring circuit comprises:

a first switching element on-off controlled depending on whether or not the first power or a voltage corresponding to the first power input to a gate node of the first switching element meets the threshold; and a second switching element, a switching operation of which is controlled in response to the first switch element being on-off controlled, the second switching element having the second power input to one of a drain node or a source node, and when turned on, configured to output the error detection signal to another one of the source node or the drain node, wherein, in operation, when the first switching element is turned on, the second switching element is turned off and does not output the error detection signal, and when the first switching element is turned off, the second switching element is turned on, and in response to the second power or a voltage corresponding to the second power being input to the one of the drain node or the source node, outputs the error detection signal to the other one of the source node or the drain node; and, a main controller configured to output the second power to the power monitoring circuit and to receive the error detection signal from the power monitoring circuit.

2. The display device according to claim 1, wherein, in operation, when the first switching element is turned on in response to the first power or a voltage corresponding to the first power being input to the gate node of the first switching element, a base voltage input to one of a source node or a drain node of the first switching element is input to a gate node of the second switching element, thereby turning off the second switching element, and when the first switching element is turned off in response to the first power or the voltage corresponding to the first power being not input or being input to the gate node of the first switching element with a value failing to meet the threshold, the second power or the voltage corresponding to the second power is input to the gate node of the second switching element, thereby turning on the second switching element.

3. The display device according to claim 1, wherein the first power is a turn-on level voltage of the first switching element, the second power is a turn-on level voltage of the second switching element, and the base voltage is a turn-off level voltage of the second switching element.

4. The display device according to claim 1, wherein the panel controller is configured to control an operation of the display panel using an operating power output from the power management integrated circuit, and even in a case in which the operating power supplied to the panel controller is in an off state in response to an abnormality in the power management integrated circuit, the power monitoring circuit is configured to, separately than the panel controller, determine that an operating state of the power management integrated circuit is abnormal and outputs the error detection signal to the main controller.

5. The display device according to claim 1, wherein the first power is a gate driving voltage supplied to the gate driver.

6. The display device according to claim 1, wherein the first power is power supplied to at least one of the data driver, the display panel, or a memory associated to the display device.

7. A power monitoring circuit, comprising:

a first input node configured to receive a first power output from a power management integrated circuit;

a second input node configured to receive a second power;

an error detection signal output node configured to output an error detection signal indicative of an abnormality in the power management integrated circuit, depending on whether or not the first power meets a threshold; and an error detection circuit configured to feed the error detection signal to the error detection signal output node, the error detection signal corresponding to the second power or a voltage corresponding to the second power, upon the received first power not meeting the threshold, wherein the error detection circuit includes:

a first switching element and a second switching element, the first switching element having a gate node electrically connected to the first input node, one of a drain node or a source node electrically connected a gate node of the second switching element, and another one of the source node or the drain node electrically connected to a base voltage node; and the second switching element having a gate node electrically connected to the second input node, one of a drain node or a source node electrically connected to the second input node, and another one of the source node or the drain node electrically connected to the error detection signal output node.

8. The power monitoring circuit according to claim 7, wherein, when the first power configured to be received at the first input node is a voltage higher than a maximum allowable voltage of the first switching element, the gate node of the first switching element is configured to be electrically connected to the first input node through a voltage divider element, the voltage divider element including:

two resistors connected in series between the first input node and the base voltage node, and the gate node of the first switching element connected to a point at which the two resistors are connected.

9. The power monitoring circuit according to claim 7, wherein, when the second power configured to be received at the second input node is a voltage higher than a maximum allowable voltage of the second switching element, the gate node of the second switching element is configured to be electrically connected to the second input node through a voltage divider element, the voltage divider element including two resistors connected in series between the second input node and the base voltage node, and the gate node of the second switching element connected to a point at which the two resistors are connected.

10. The power monitoring circuit according to claim 7, wherein the error detection signal output node is electrically connected to a main controller, and when the error detection signal output from the error detection signal output node is a voltage higher than a maximum allowable voltage of the main controller, the second input node is configured to connect to the one of the drain node or the source node of the second switching via a resistor.

11. A display device, comprising:

a display panel including a plurality of data lines and a plurality of gate lines;

a data driver configured to drive the plurality of data lines;

a gate driver configured to drive the plurality of gate lines;

a panel controller configured to control the data driver and the gate driver;

a power management integrated circuit configured to output a first power to be supplied to at least one of the data driver, the gate driver, the display panel, or the panel controller; and a power monitoring circuit configured to determine whether or not the first power is ordinarily output from the power management integrated circuit and to output an error detection signal indicative of an abnormality in the power management integrated circuit, upon determining that the first power is abnormal, the error detection signal being in response to a second power or a voltage corresponding to the second power, wherein the power monitoring circuit comprises:

a first switching element on-off controlled depending on whether or not the first power or a voltage corresponding to the first power input to a gate node of the first switching element meets the threshold; and a second switching element, a switching operation of which is controlled in response to the first switch element being on-off controlled, the second switching element having the second power input to one of a drain node or a source node, and when turned on, configured to output the error detection signal to another one of the source node or the drain node, wherein, in operation, when the first switching element is turned on, the second switching element is turned off and does not output the error detection signal, and when the first switching element is turned off, the second switching element is turned on, and in response to the second power or a voltage corresponding to the second power being input to the one of the drain node or the source node, outputs the error detection signal to the other one of the source node or the drain node.

12. The display device according to claim 11, wherein the power monitoring circuit is configured to operate separately than the panel controller.

13. A method, comprising:

detecting, by a power monitoring circuit, a first power output from a power management integrated circuit of a display device, the display device including:

a display panel including a plurality of data lines and a plurality of gate lines;

a data driver configured to drive the plurality of data lines; a gate driver configured to drive the plurality of gate lines; a panel controller configured to control the data driver and the gate driver; and the power management integrated circuit configured to output a first power to be supplied to at least one of the data driver, the gate driver, the display panel, or the panel controller; and outputting, by the power monitoring circuit and to a main controller, an error detection signal indicative of an abnormality in the power management integrated circuit in a case the first power does not meet a threshold, the error detection signal being output in response to a second power provided to the power management integrated circuit by the main controller where in the power monitoring circuit includes:

an error detection circuit, said error detection circuit includes:

a first switching element and a second switching element, the first switching element having a gate node electrically connected to a first input node, one of a drain node or a source node electrically connected a gate node of the second switching element, and another one of the source node or the drain node electrically connected to a base voltage node; and the second switching element having a gate node electrically connected to the second input node, one of a drain node or a source node electrically connected to a second input node, and another one of the source node or the drain node electrically connected to an error detection signal output node.

14. The method of claim 13, where in the power monitoring circuit includes:

the first input node configured to receive a first power output from a power management integrated circuit;

the second input node configured to receive a second power;

the error detection signal output node configured to output the error detection signal indicative of an abnormality in the power management integrated circuit, depending on whether or not the first power meets a threshold; and the error detection circuit configured to feed the error detection signal to the error detection signal output node, the error detection signal corresponding to the second power or a voltage corresponding to the second power, upon the received first power not meeting the threshold.

15. The method of claim 14, further comprising generating a voltage corresponding to the first power through a voltage divider element coupled between the error detection circuit and the output of the power management integrated circuit, the voltage divider element including two resistors connected in series between the first input node and the base voltage node, and the gate node of the first switching element connected to a point at which the two resistors are connected.

16. The method of claim 14, further comprising generating a voltage corresponding to the second power through a voltage divider element coupled between the gate node of the second switching element and the second input node, the voltage divider element including two resistors connected in series between the second input node and the base voltage node, and the gate node of the second switching element being connected to a point at which the two resistors are connected.

* * * * *